US007722213B2

(12) United States Patent
Inoue et al.

(10) Patent No.: US 7,722,213 B2
(45) Date of Patent: May 25, 2010

(54) LIGHTING APPARATUS

(75) Inventors: Masaru Inoue, Kanagawa-ken (JP); Keiichi Shimizu, Kanagawa-ken (JP); Sumio Hashimoto, Kanagawa-ken (JP); Hirokazu Otake, Kanagawa-ken (JP); Mitsuhiko Nishiie, Shizuoka-ken (JP); Takuro Hiramatsu, Kanagawa-ken (JP); Masatoshi Kumagai, Kanagawa-ku (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 12/205,460

(22) Filed: Sep. 5, 2008

(65) Prior Publication Data

US 2009/0067172 A1 Mar. 12, 2009

(30) Foreign Application Priority Data

Sep. 5, 2007 (JP) ..... 2007-230701

(51) Int. Cl.
*F21V 7/00* (2006.01)

(52) U.S. Cl. ..... 362/241; 362/297; 362/346; 362/347; 362/249.02; 362/249.05

(58) Field of Classification Search ..... 362/297, 362/306, 307, 308, 346, 347, 237, 240, 241, 362/249.02, 249.06, 296.05, 545
See application file for complete search history.

(56) References Cited

U.S. PATENT DOCUMENTS

| | | | | |
|---|---|---|---|---|
| 5,580,156 | A * | 12/1996 | Suzuki et al. | 362/184 |
| 6,840,654 | B2 * | 1/2005 | Guerrieri et al. | 362/241 |
| 7,241,019 | B1 * | 7/2007 | Tsai et al. | 359/520 |
| 2003/0137838 | A1 * | 7/2003 | Rizkin et al. | 362/240 |
| 2003/0156410 | A1 * | 8/2003 | Ter-Hovhannisian | 362/241 |

FOREIGN PATENT DOCUMENTS

JP 2006-172895 6/2006

OTHER PUBLICATIONS

English language translation of JP2006-172895.

* cited by examiner

*Primary Examiner*—Laura Tso
(74) *Attorney, Agent, or Firm*—DLA Piper LLP US

(57) ABSTRACT

A lighting apparatus comprises a housing and a first reflector. The first reflector is mounted beneath the light source and includes a plurality of segmented reflectors, each having at its top, a installation hole and at its bottom, an opening wider than the installation hole. A second reflector is positioned beneath the first reflector. The height of the second reflector causes a first light shielding angle defined by a straight line passing through the installation hole and the bottom edge of the corresponding segmented reflector to be larger than a second light shielding angle defined by a straight line passing through the bottom edge of the segmented reflector and the bottom edge of the second reflector.

3 Claims, 4 Drawing Sheets

LIGHTING APPARATUS

CROSS REFERENCE TO RELATED APPLICATIONS

This application is based upon and claims the benefit of priority from the prior Japanese Application No. 2007-230701, filed on Sep. 5, 2008, the entire contents of which are incorporated herein by reference.

FIELD OF THE INVENTION

The present invention relates to a lighting apparatus such as ceiling recess installation type down-light, which utilizes a semiconductor light emitting device such as an LED (light emitting diode) as a light source.

BACKGROUND OF THE INVENTION

As one example of such a down-light, there is known a down-light, wherein a light source block, a lighting circuit block, a mounting board and a terminal block are assembled in a housing and wherein a frame is mounted to, a bottom opening for emitting light (see, e.g., Japanese laid-open patent application JP2006-172895A, paragraphs 0020-0030, FIGS. 1-7).

In such a down-light, a mounting board is provided horizontally in the housing. A lighting circuit block and a terminal block are mounted on the upper surface of the mounting board. Further a light source block is mounted on the lower surface of the mounting board. The light source block comprises a printed circuit board mounting thereon a plurality of LEDs, and a lens system for controlling spatial distribution of luminous intensity of light emitted from the LEDs. The lens system is formed in a thin cylindrical shape by light-transmissive material. The lens system is provided with a space for accommodating a printed circuit board on which a depression is formed on its upper side for arranging each LED. The frame comprises a cylindrical side wall whose diameter gradually expandings from top to bottom and a flange provided at the bottom portion of the frame. The flange is so formed to hang over a brim portion of the housing and catch on a lip of the ceiling recess. The inner surface of the side wall serves as a reflective surface for guiding downward light transmitted through the lens system from the light source block and introduced into the cylindrical side wall.

In the down-light, disclosed in the prior art JP2006-172895A, the light emitting surface of the lens system which controls luminous intensity distribution of the light emitted from the LED is horizontally disposed at the level closing the upper opening of the frame. As a result, the entire region shines brightly. As a result, the light source block itself fails to achieve a desirable light shielding angle.

In order to counteract the disadvantage in the down-light disclosed in the prior art JP2006-172895A, the lens system may be directly allocated beneath the housing by removing the frame which undesirably reflects the light from the light source block. However, there occurs in such a modification another problem that since the luminosity of the LED itself is extremely high, a dazzle feeling of the light source block becomes strongly conspicuous. In a down-light, wherein the frame is allocated beneath the light source block like the down-light disclosed in the prior art JP2006-172895A, a certain degree of light shielding angle can be ensured by a frame. However, for enlarging the light shielding angle further, the height of the frame must be increased. When the height of the frame is increased, there occurs still another problem that the downright illumination zone obtained by reflection on the frame becomes narrower.

Further, the lens system provided in the down-light disclosed in the prior art JP2006-172895A is formed to have a total-internal-reflection surface for effectively utilizing the light from the LED. A lens system having such a total-internal-reflection surface must have a thickness larger than a certain amount. Therefore, in the manufacturing of the lens system, a molding tact time becomes long. As a result, the manufacture efficiency is insufficient and thus the manufacturing of the lens system is costly.

SUMMARY OF THE INVENTION

It is an object of the present invention to provide a lighting apparatus capable of deadening glare by controlling an expected light shielding angle with a luminous intensity distribution control member that controls the luminous intensity distribution of the light emitted from a semiconductor light emitting device and which lowers costs of the lighting apparatus.

In order to achieve the object, the lighting apparatus according to a first aspect of the present invention is comprised of a housing and a first reflector. The first reflector includes a plurality of segmented reflectors, each having at its top a installation hole and at its bottom an opening wider than the installation hole. A second reflector is positioned beneath the first reflector. The height of the second reflector causes a first light shielding angle defined by a straight line passing through the installation hole and the bottom edge of the corresponding segmented reflector to be larger than a second light shielding angle defined by a straight line passing through the bottom edge of the segmented reflector and the bottom edge of the second reflector.

In order to achieve the object, the lighting apparatus according to a second aspect of the present invention is comprised of a housing, a light source comprising a plurality of semiconductor light emitting devices, and positioned in the housing so as that the semiconductor light emitting devices are directed downward, and a first reflector. The first reflector includes a plurality of segmented reflectors, each having at its top, a installation hole for arranging the semiconductor light emitting device and at its bottom, an opening wider than the installation hole. Adjacent segmented reflectors form a downward crest beneath the installation hole, and the installation hole is allocated between adjacent crests at an obliquely upward recess from the crest.

The lighting apparatus according to the first and the second aspects of the present invention can be utilized in a ceiling recess. As the semiconductor light emitting device for the light source, LEDs, organic EL devices (organic electro-luminescence device), etc. can be employed. A perfect diffused reflection can be established for the first reflector and second reflector. Especially, in the second aspect of the lighting apparatus the downward crest between each segmented reflector can be continuous. The shape of these crests correspond to the bottom geometry of the first reflector. For example, when the bottom geometry of the first reflector is annular, the crest radially extended from the central part is formed. When the bottom geometry of the first reflector is square, a curb-lattice shaped crest is formed.

Particularly, in the lighting apparatus according to the second aspect of the invention, adjacent segmented reflectors form a downward crest. The segmented reflectors may be a configuration which share the crest, or independent segmented reflectors may be in a configuration in which they tightly adjoin each other at their crests or adjoin each other leaving a small gap.

In the lighting apparatus according to the second aspect of the invention, the luminous intensity distribution of the light emitted from the semiconductor light emitting device is controlled by the first reflector. Also, the first reflector is easy to manufacture, as compared with manufacturing of total-reflective lens. Manufacture is easier when molding the first reflector employing a white resin. Therefore, the reduced manufacturing cost of the first reflector results in a lower cost lighting apparatus.

Further to the lighting apparatus according to the second aspect of the present invention, a lighting apparatus according to a third aspect of the present invention comprises, a second reflector having openings at its top and bottom, wherein the second reflector is positioned beneath the first reflector so that the open top of the second reflector is connected to the bottom edge of first reflector, and wherein the height of the second reflector causes a first light shielding angle specified by a straight line passing through one of the semiconductor light emitting devices and the crest of the corresponding segmented reflector to be larger than a second light shielding angle defined by a straight line passing through the bottom edge of the segmented reflector and the bottom edge of the second reflector.

Further to the lighting apparatus according to the third aspect of the invention, the lighting apparatus according to the fourth aspect of the invention includes a light-transmissive insulation cover which covers a lower opening of the first light reflector and an upper opening of the second reflector, wherein the upper opening of the second reflector is smaller than a bottom opening.

DESCRIPTION OF THE PREFERRED EMBODIMENTS

Figure 1:
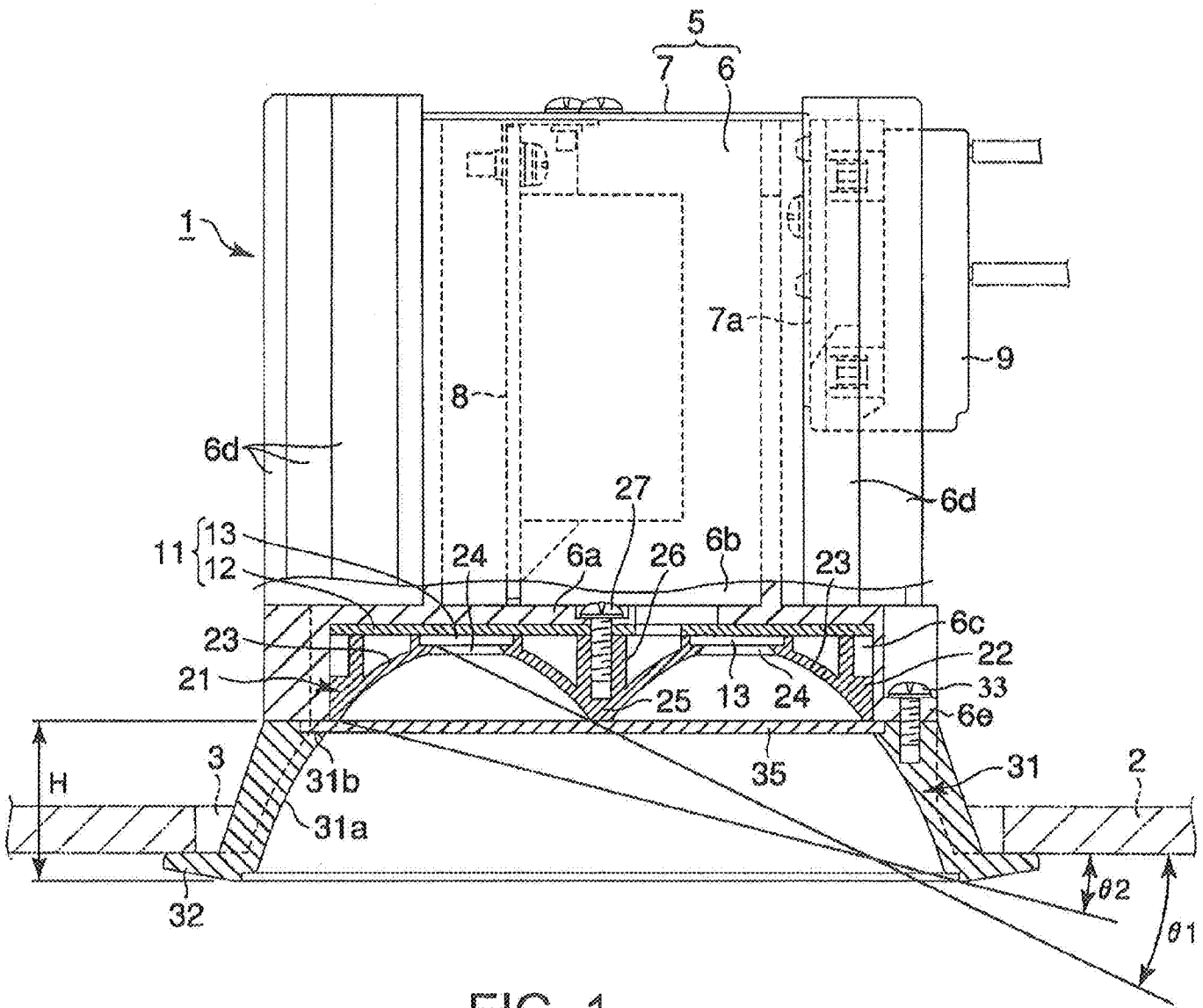
FIG. 1 is a partial section showing a down-light, according to one embodiment of the present invention.

Referring now to the drawings, FIGS. 1 to 4, embodiments of the present invention will be explained hereinafter.

Figure 2:
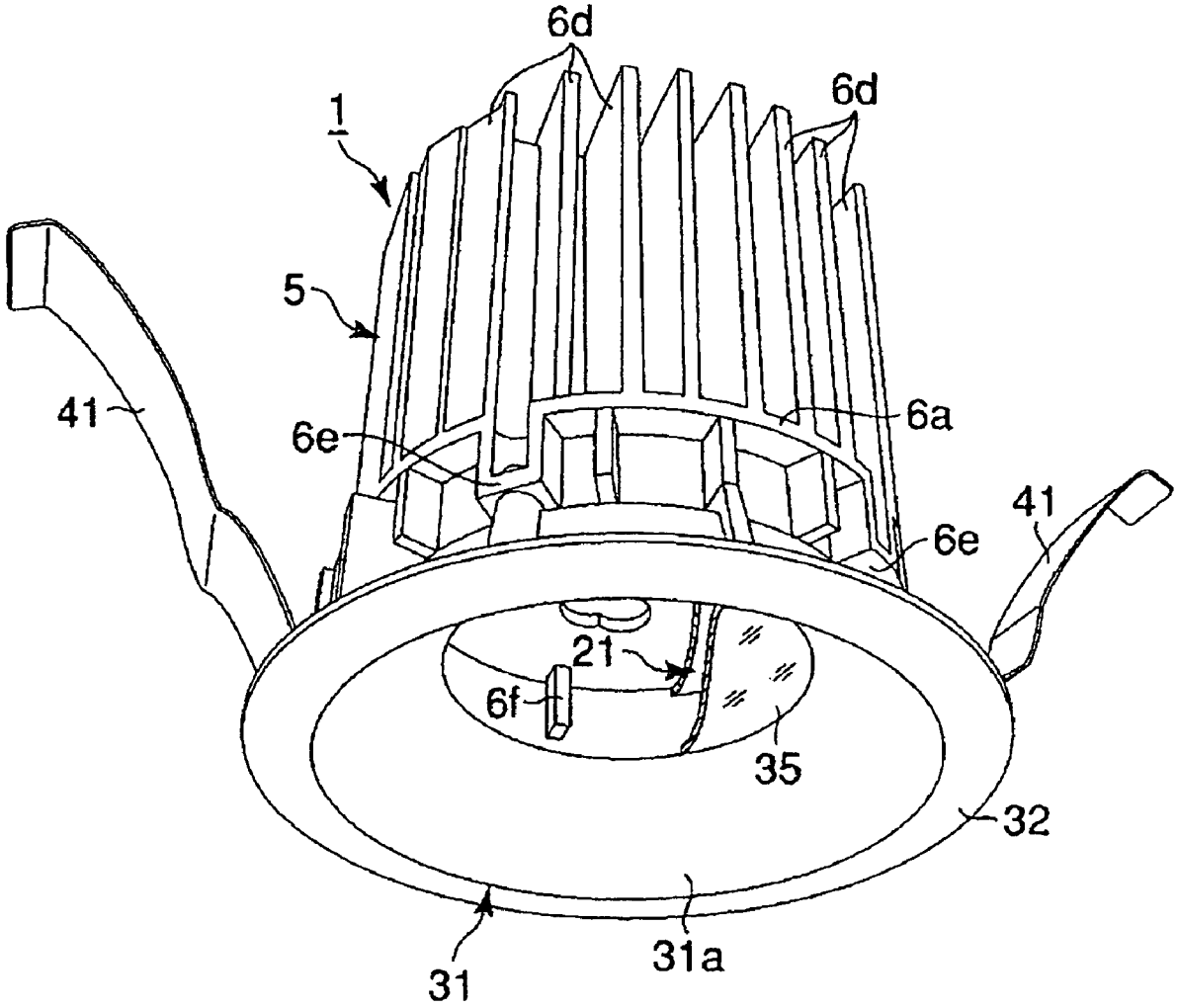
FIG. 2 is a partial cut-away perspective view of the down-light, of FIG. 1, which is seen from obliquely downward.
Figure 3:
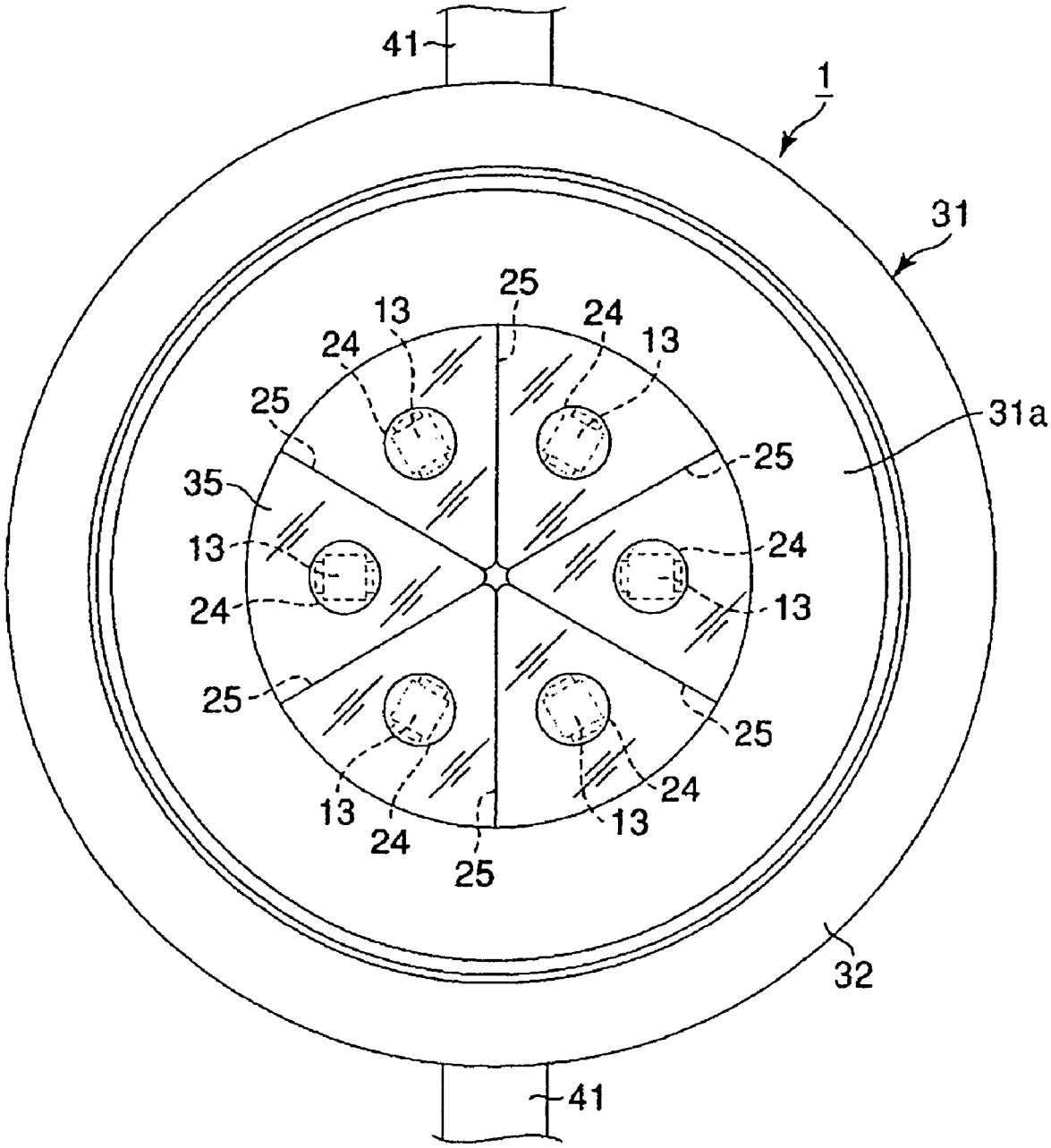
FIG. 3 is a bottom view showing the down-light, of FIG. 1.

In FIG. 1 to FIG. 3, the reference numeral 1 denotes a lighting apparatus, for example, a down-light. A down-light 1 is installed in a recess, for example on an indoor ceiling 2 as shown in FIG. 1. In FIG. 1, the reference numeral 3 denotes the ceiling recess of the ceiling 2. The ceiling recess 3 is an opening left behind that an old down-light, has been removed, or an opening newly bored in the ceiling 2.

The down-light 1 is provided with a housing 5, a light source 11, an electric power unit 8, a terminal block 9, a first reflector 21, a second reflector 31, a transparent cover plate 35, and a pair of mounting springs 41.

As shown in FIG. 1, the housing 5 is preferably made of metal in order to easily dissipate of the heat emitted from an LED which will be mentioned later. The housing principal member 6 has a power supply unit storage space 6*b* on the upper side of the annular bottom wall 6*a*. The housing principal member 6 also includes a light source mount block 6*c* beneath the bottom wall 6*a*, and a plurality of heat radiation fins 6*d* on the perimeter of the bottom wall 6*a*. The light source mount block 6*c* is configured in a short cylindrical shape opening its bottom end. The fastening portion 6*e* is formed in the outside plurality place of the bottom opening edge of the light source mount block 6*c*. The upper end opening of the power supply unit storage space 6*b* is closed by the top plate 7.

The electric power unit 8 and the terminal block 9 are mounted to the housing 5. The electric power unit 8 is accommodated in the power supply unit storage space 6*b*, and the terminal block 9 is mounted to the part 7*a* bent over the side of the housing principal member 6 of the top plate 7. The electric power unit 8 controls the lighting current of LED which will be mentioned later, and the terminal block 9 supplies a commercial AC power to the electric power unit 8.

As shown in FIG. 1, the light source 11 and the first reflector 21 are accommodated in the light source mount block 6*c*. The light source 11 is provided with a plurality of semiconductor light emitting devices, for example, LEDs 13. The semiconductor light emitting devices are mounted on the surface of the light source support board 12.

The light source support board 12 has an annular shape, and the back of the light source support board 12 where the to LEDs 13 is allocated in the light source mount block 6*c* by tightly contacting to the under side of the bottom wall 6*a*. Reference numeral 6*f* in FIG. 2 denotes a positioning convex, for example, a rib. A plurality of the positioning convexes or the ribs are provided on the inner surface of the light source mount block 6*c*. Here, in FIG. 2, only one rib 6*f* is typically illustrated for simplicity of explanation. When a periphery of the light source support board 12 engages with the rib 6*f*, the light source 11 is positioned to the light source mount block 6*c*.

The light source 11 has six LEDs 13, as shown, for example in FIG. 3. These six LEDs 13 are annularly allocated at constant intervals, i.e., 60 degrees, on the light source support board 12. The LED 13 is provided with an LED chip which illuminates blue light, a reflector enclosing the LED chip and light-transmissive sealing resin containing fluorescent substance which is filled in the reflector for sealing the LED chip. The fluorescent substance is excited by the blue light emitted from the LED chip and primarily emits yellow light complimentary to the blue light. Therefore, each LED 13 emits a white light.

Figure 4:
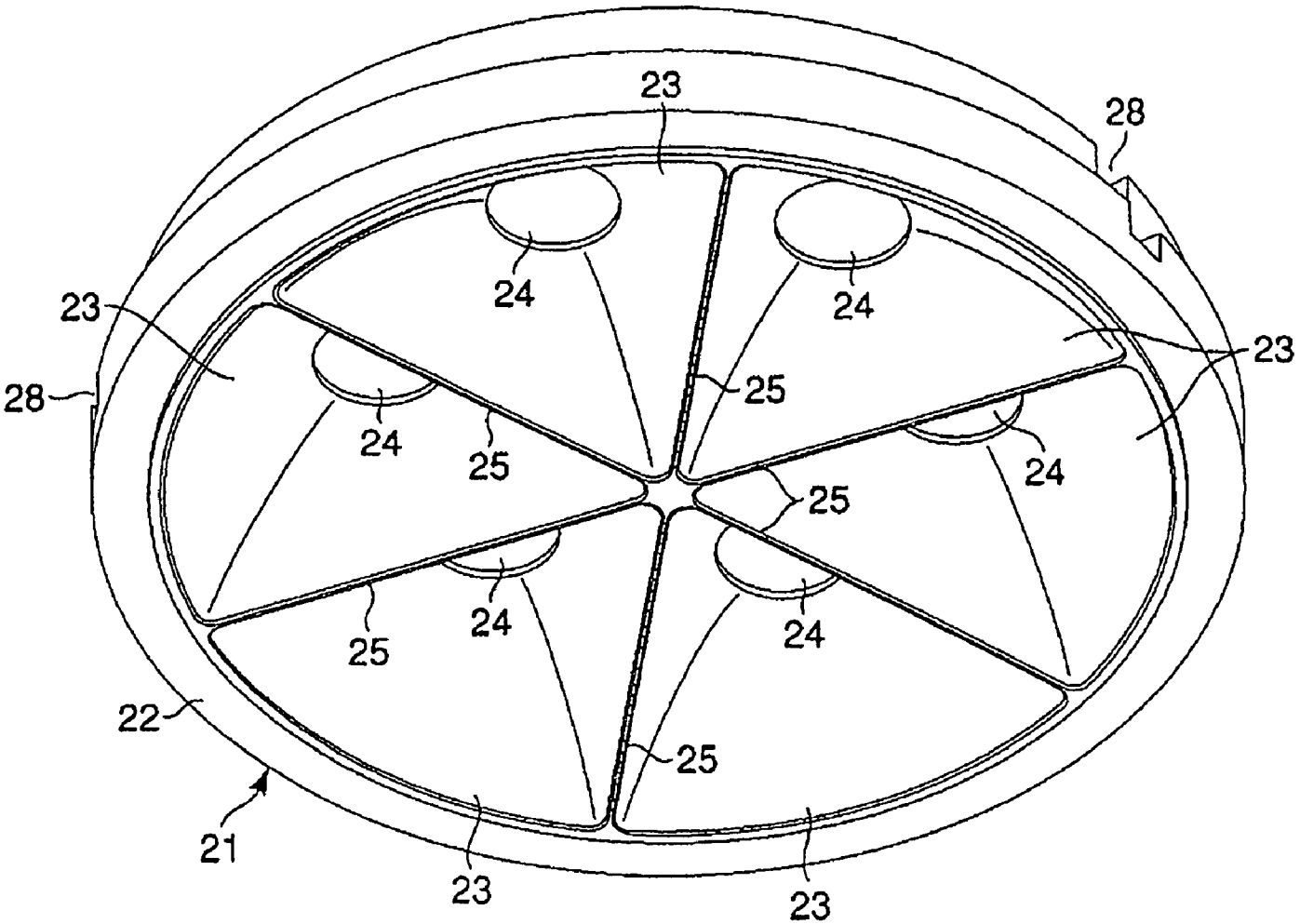
FIG. 4 is a perspective view showing a second reflector equipped in the down-light, of FIG. 1.

The first reflector 21 is a cast of a white synthetic resin, and functions as first luminous intensity distribution controlling member that controls the luminous intensity distribution of the light emitted from the LED 13. The first reflector 21 is positioned in the light source mount block 6*c* at the light source 11 bottom. The first reflector 21 includes a segmented reflector 23 for each LED 13. The segmented reflectors 23 open inside the frame 22 as shown in FIG. 1 and FIG. 4. The first reflector 21 is formed corresponding to the shape of the light source support board 12. According to the above embodiment, the frame 22 of the first reflector 21 is a ring shape.

Each segmented reflector 23, which is formed as an upward convex, has a hole 24 in the top of the convex. The bottom opening of the segmented reflector 23 is larger than the hole 24. A downward crest 25 is formed between each segmented reflector 23 adjoined along the direction of a circumference of the frame 22. Each crest 25 has a V shape as represented and shown in FIG. 1.

Since each crest 25 extends radial from the central part of the first reflector 21 and the above-mentioned central part and the frame 22 are covered, each crest 25 is formed so that the segmented reflector 23 is divided every 60 degrees. While these crests 25 are formed below the hole 24, each hole 24 is positioned between the crests 25 which are adjacent. The side wall running from the inner periphery of each crest 25 and the frame 22 to the hole 24 is formed by the reflecting barriers in which the section makes an arc.

The first reflector 21 has a screw reception threaded boss 26 who protrudes upward at the back. In the case of the above embodiment, the screw reception threaded boss 26 is formed in the central part back of the first reflector 21. The first reflector 21 is fixed to the light source mount block 6*c* with the fastening screw 27 which extends from the upper part through the central part of the bottom wall 6*a* and the light source support board 12. The upper end of the frame 22 of the first reflector 21 sandwiches the periphery of the light source support board 12 between the bottom walls 6*a*, and thereby, the back of the light source support board 12 is close to the undersurface of the bottom wall 6*a*. The reference numeral 28 in FIG. 4 denotes a plurality of positioning slots formed in the frame 22. By carrying out concavo-convex engaging of the positioning slot 28 to the rib 6*f*, the first reflector 21 is positioned to the light source mount block 6*c* and the light source 11.

In FIG. 1, angle θ1 represents the light shielding angle of the light source 11. The light shielding angle θ1 is prescribed by the straight line which passes through LED 13 positioned at the installation hole 24 of the segmental reflector 23, and the crest 25 of the segmental reflector 23 of the first reflector 21, and, more correctly, the angle between the straight line and ceiling 2. Even if one looks up at the down-light 1 within the angle range, the LED 13 fails to be visually recognized.

The second reflector 31 functions as second luminous intensity distribution control member that controls the luminous intensity distribution of the light emitted from the LED 13, and is cast with the molding material of the first reflector 21 using the same white synthetic resin. As shown in FIG. 1, the upper end opening of the second reflector 31 is smaller than a bottom opening. In other words, the inside diameter of the second reflector 31 is molded to increase from the upper end opening to the bottom opening. The inner surface 31*a*, which is the reflective surface of the second reflector 31, is formed, for example, as a curved surface. The inner surface 31*a* may be a straight slope.

The second reflector 31 has the annular flange 32 protruded outward at the bottom. The annular flange 32 has a larger diameter than the ceiling recess 3 of the ceiling 2.

The second reflector 31 is positioned at the first reflector 21 bottom, and is connected with the bottom opening of the housing 5 with the fastening screw 33 screwed in through each fastening portion 6*e* of the above-mentioned housing principal member 6. One fastening screw 33 is shown in FIG. 1. The inner surface 31*a* of the second reflector 31 is continuous with the inner surface (reflective surface) of the segmented reflector 23 of the first reflector 21. In other words, the inner surface 31*a* of the second reflector 31 and the inner surface (reflective surface) of the first reflector 21 are continuous so that no discontinuity exists between the inner surface 31*a* of the second reflector 31 and the bottom inner surface of the segmented reflector 23. Therefore, the entire are of the inner surface 31*a* shines brightly.

The light-transmissive insulation cover 35 is supported by the second reflector 31. The transparent cover plate 35 can also close and provide the undersurface opening of the second reflector 31. In the above embodiment, the upper end opening of the second reflector 31 is closed, by the transparent cover plate 35. As compared with the case where the transparent cover plate 35 is positioned in the undersurface opening of the second reflector 31, the small transparent cover plate 35 can be smaller and less costly.

The periphery of the transparent cover plate 35 is supported by the annular stepped recess 31*b* which is formed in the edge of the upper end opening of the second reflector 31. The periphery of the transparent cover plate 35 is sandwiched between the bottom opening surface of the housing 5 and the bottom of the annular stepped recess 31*b*. The transparent cover plate 35 includes of a clear glass board, a transparent acrylic resin board, etc., for example, and electrically insulates the light source 11. It is also possible to replace the transparent plate with a resin board which diffuses light, or it is also possible to utilize a transparent plate and a diffuse transmission plate together.

In FIG. 1, θ2 denotes the light shielding angle of the first reflector 21. The light shielding angle θ2 is defined by the edge of the reflective inner surface of the segmented reflector 23 that is visible as a bright surface. Thus, angle θ2 is defined by a straight line which passes through the bottom opening of the first reflector 21, and the edge of the bottom opening of the second reflector 31. Thus angle θ2 is the angle between that straight line and ceiling 2. Even if one looks up at the down-light 1 in the angle range, the reflective surface of the first reflector 21 fails to be visually recognized. The height H of the second reflector 31 is selected so that the light shielding angle θ2 becomes smaller than the light shielding angle θ1 of the light source 11.

Although not illustrated, spring mount portions are formed 180 degrees apart on the external surface of the second reflector 31. The spring mount portions attach to the bottom opening of the spring 41. Therefore, a pair of mounting springs 41 positioned in the radial direction of the second reflector 31 are movable covering a first position which is slanted relative to the housing 5, and a second position positioned so that the lateral surface of the housing 5 may be met.

The down-light 1 is installed in the ceiling 2 by elastically deforming the pair of mounting springs 41, and then inserting into the recess 3 on the ceiling 2 to the position that the annular flange 32 abuts the ceiling 2. The down-light 1 is pushed up, and it opens so that the pair of attachment springs 41 may become slanting gradually towards the first position. As a result, the diffuse reflection and the annular flange 32 of these attachment spring 41 embed, the edge of the hole 3 is sandwiched, and the embedding state of the down-light 1 is maintained.

Lighting by the down-light 1 is accomplished by the light which LEDs 13 emit, the light which is reflected by each segmented reflector 23 of the first reflector 21, and the light which is reflected by the second reflector 31.

The light emitted from LEDs 13 strikes the entire inner surface (reflective surface) of the segmented reflector 23. Since light is diffused by the entire area of the inner surface of each segmented reflector 23, the entire reflective surface of the first reflector 21 shines. The first reflector 21 is a light reflector which has a prism object or not a lens system but the lower end opening is formed more greatly than these. Since the inner surface of the first reflector 21 can be considered a light-emitting surface, a large light-emitting surface can be assured. Therefore, it is easy to project the optical power of LEDs 13 by reflection by each segmented reflector 23 of the first reflector 21.

The light which enters into the second reflector 31 covers the entire inside area 31*a* of the second reflector 31. As a result, as the inside surface 31*a* of the second reflector 31 also complete diffuses and reflects the incidence light, it shines like an illumination source. Further, the second reflector 31 is positioned at the bottom of the first reflector 21 so that the inner surface of each segmented reflector 23 is at the same level relative to the inside surface 31*a* of the second reflector 31. Light reflected by the first reflector 21 easily enters the second reflector 31, and shadows are avoided.

Therefore, even though the first reflector 21 and the second reflector 31 are split vertically, the vertically joining inner surfaces 21*a* and 31*a* of the first and second reflectors 21 and 31 can be brightened in their entirety.

The down-light 1 controls luminous intensity distribution of the light which LEDs 13 emit as a result of the first reflector 21. For this reason, as compared with the case where the luminous intensity distribution is controlled by a lens system with a total reflection surface, the first reflector 21 is easy to manufacture. In the above embodiment of a lens system wherein the first reflector 21 is molded from a white synthetic resin, manufacture is easier. Therefore, reduction of the manufacturing cost of the first reflector 21 reduces the cost of the down-light 1.

In the down-light, 1, a plurality of segmented reflectors 23 positioned beneath the light sources 11 adjoin each other so as to establish the downward crest 25. Accordingly, when the first reflector 21 is looked at from below, as shown in FIG. 3, each crest 25 is seen to be divided into each segmented reflector 23. Crests 25 are positioned beneath the installation hole 24 in which LEDs 13 of the light source 11 are positioned Therefore, a part of the light which LEDs 13 emit can be interrupted by each crest 25 and the frame 22.

In other words, the LEDs 13 are provided in the slanting upper part of the adjoining segmental reflector 23 which extends to the crest 25. Therefore, the light shielding angle θ1 of each light source 11, defined by a straight line which passes through each LED 13 and the crest 25 is such that the dazzle feeling from high-intensity LEDs 13 is mitigated.

The luminosity of the inner surface of each segmented reflector 23 is greated than a case where specular reflection occurs since the inner surface provides for diffuse reflection. Thus, the inside of the first reflector 21 can be considered a bright surface with increased luminosity. The second reflector 31 is positioned beneath the first reflector 21 in succession. Therefore, the light shielding angle θ2 of the first reflector 21, defined by a straight line passing through the edge of the bottom opening of the second reflector 31 and the bottom opening of the first reflector 21 is set so that glare from the first reflector 21 is mitigated.

As noted above, the light shielding angle θ2 of the first reflector 21 is smaller than the light shielding angle θ1 of a light source. It is not necessary to make the light shielding angle θ2 of the first reflector 21 the same as the light shielding angle θ1 of a light source. Therefore, height H of the second reflector 31 can be made low. Since the illuminated zone obtained by reflection in the lower part in the second reflector 31 is broad, good optical performance of the down-light 1 is obtained.

Since height H of the second reflector 31 can be low, the height of the down-light 1 with the second reflector 31 can be low, and the distance down-light 1 extends into the ceiling can be made small.

In the lighting apparatus according to a first aspect of the present invention, since the light shielding angle defined by a straight line passing through the installation hole and the bottom edge of the corresponding segmented reflector need not be the same as the light shielding angle defined by the straight line which passes through the bottom edge of the segmented reflector and the second reflector, the height of the second reflector can be made low. Therefore, the dazzle feeling from high-intensity LEDs 13 and glare had can be mitigated.

In the lighting apparatus according to the second aspect of the present invention, since a plurality of segmented reflectors positioned below the light source form downward crests, when one looks up at the first reflector, each crest is provided so that each segmented reflector may be divided. An installation hole is provided in the top of each segmented the segmental reflector so that the installation holes are provided between the crests. Therefore, a part of the light emitted from the semiconductor light emitting device is interrupted by the crest of the first reflector for controlling the luminous intensity distribution. The light shielding angle over a light source, i.e., the light shielding angle defined by the straight line which passes through a semiconductor light emitting device and a crest of the segmental reflector of the first reflector can be selected to mitigate the dazzle feeling from a light source.

In the lighting apparatus according to the second aspect of the present invention, while being able to secure the light shielding angle of a light source by the member which controls luminous intensity distribution of the light and being able to reduce a dazzle feeling, the cost of the lighting apparatus can be reduced.

In the lighting apparatus according to the third aspect of the present invention, since the light shielding angle defined by a straight line which passes through a semiconductor light emitting device and the crest of the corresponding segmented reflector need not be the same as the light shielding angle defined by a straight line which passes through the bottom edge of the segmented reflector and the bottom edge of the second reflector, the height of the second reflector can be made low. Therefore, while being able to lower the height of a lighting apparatus, the illuminated zone obtained by reflection by the second reflector can be controlled.

Further to the second aspect of the lighting apparatus, in the lighting apparatus according to the third aspect of the present invention, while being able to lower the height of a lighting apparatus with the second reflector at the bottom of the first reflector, the illuminated zone obtained by reflection by the second reflector can be controlled.

In the lighting apparatus according to the fourth aspect of the present invention, the semiconductor light emitting device can be electrically insulated from that lower part with a transparent cover plate. Since a transparent cover plate closes an upper end opening smaller rather than the bottom opening of the second reflector, it can be smaller as compared with the case where the bottom opening of the second reflector is closed, and the transparent cover plate can be made at a low cost.

Further to the third aspect of the lighting apparatus, in the lighting apparatus according to the fourth aspect of the present invention, a semiconductor light emitting device can be electrically insulated from the lower part with a small transparent cover plate.

What is claimed is:

1. A lighting apparatus, comprising:

a housing;

a first reflector, which is mounted beneath the light source and comprises a plurality of segmented reflectors, each having on its top, a installation hole and on its bottom, an opening wider than the installation hole; and a second reflector positioned beneath the first reflector, wherein the height of the second reflector causes a first light shielding angle defined by a straight line passing through the installation hole and the bottom edge of the corresponding segmented reflector to be larger than a second light shielding angle defined by a straight line passing through the bottom edge of the segmented reflector and the bottom edge of the second reflector.

2. A lighting apparatus, comprising a housing;

a light source comprising a plurality of semiconductor light emitting devices, and positioned in the housing so that the semiconductor light emitting devices are directed downwardly;

a first reflector, which is mounted beneath the light source and comprises a plurality of segmented reflectors, each having on its top, a installation hole for arranging one of the plurality of semiconductor light emitting devices and on its bottom, an opening wider than the installation hole; and a second reflector having openings at its top and bottom, which is positioned beneath the first reflector so that the open top of the second reflector is connected to the bottom edge of the first reflector, wherein adjacent segmented reflectors form a downward crest beneath the installation hole, and the installation hole is allocated between adjacent crests at an obliquely upward recess from the crest, and wherein the height of the second reflector causes a first light shielding angle defined by a straight line passing through one of the semiconductor light emitting devices and the crest of the corresponding segmented reflector to be larger than a second light shielding angle defined by a straight line passing through the bottom edge of the segmented reflector and the bottom edge of the second reflector.

3. A lighting apparatus as claimed in claim 2, further comprising:

a light-transmissive insulation cover disposed adjacent the bottom edge of first reflector, wherein the top opening of the second reflector is smaller than the bottom opening of the second reflector, and the light-transmissive insulation cover is positioned adjacent the top opening of the second reflector.

* * * * *